United States Patent [19]

MacDonald et al.

[11] 4,028,224

[45] June 7, 1977

[54] PROCESS FOR THE PREPARATION OF LOW POUR POINT LUBRICATING OILS

[75] Inventors: John M. MacDonald, Sarnia; Robert Kartzmark, Mississauga, both of Canada

[73] Assignee: Exxon Research and Engineering Company, Linden, N.J.

[22] Filed: Dec. 17, 1975

[21] Appl. No.: 641,351

Related U.S. Application Data

[63] Continuation of Ser. No. 317,608, Dec. 22, 1972, abandoned.

[52] U.S. Cl. ..... 208/92; 208/18

[51] Int. Cl.[2] ..... C10G 13/00

[58] Field of Search ..... 208/18, 92, 108

[56] References Cited

UNITED STATES PATENTS

| | | | |
|---|---|---|---|
| 2,779,713 | 1/1957 | Cole et al. | 208/18 |
| 3,308,055 | 3/1967 | Kozlowski | 208/18 |
| 3,562,145 | 2/1971 | Franz et al. | 208/96 |
| 3,663,423 | 5/1972 | Bennett et al. | 208/59 |

FOREIGN PATENTS OR APPLICATIONS

| | | | |
|---|---|---|---|
| 714,533 | 7/1965 | Canada | 208/143 |

OTHER PUBLICATIONS

Nelson, "Petroleum Refinery Engineering", Fourth Ed. (1958) McGraw-Hill Book Co., Inc., New York, pp. 219, 227, 257 & 349.

Gilbert et al., "Proceedings American Petroleum Institute", 1965, Section III, Refining, vol. 45[I] (1965) pp. 35 & 36.

*Primary Examiner*—Herbert Levine

*Attorney, Agent, or Firm*—Edward M. Corcoran

[57] ABSTRACT

Process for the preparation of low pour point lubricating oils comprising:

i. vacuum distilling a heavy naphthenic crude oil feedstock containing from about 2 to 10 weight % of sulfur based on the weight of the feedstock, said feedstock exhibiting a specific gravity ranging from about 5° to 20° API to obtain at least one distillate cut exhibiting a boiling range of from about 500° to 1000° F and a specific gravity ranging from about 10° to 25° API ii. hydrocracking said distillate cut in at least one hydrocracking zone in contact with a hydrocracking catalyst at a temperature from about 650° to 850° F, a hydrogen partial pressure of about 500 to 5000 psig. and a space velocity of from about 0.1 to 2.0 V/V/Hr;

iii. removing the low boiling light ends from the hydrocrackate; and iv. recovering a low pour point lubricating oil.

11 Claims, 1 Drawing Figure

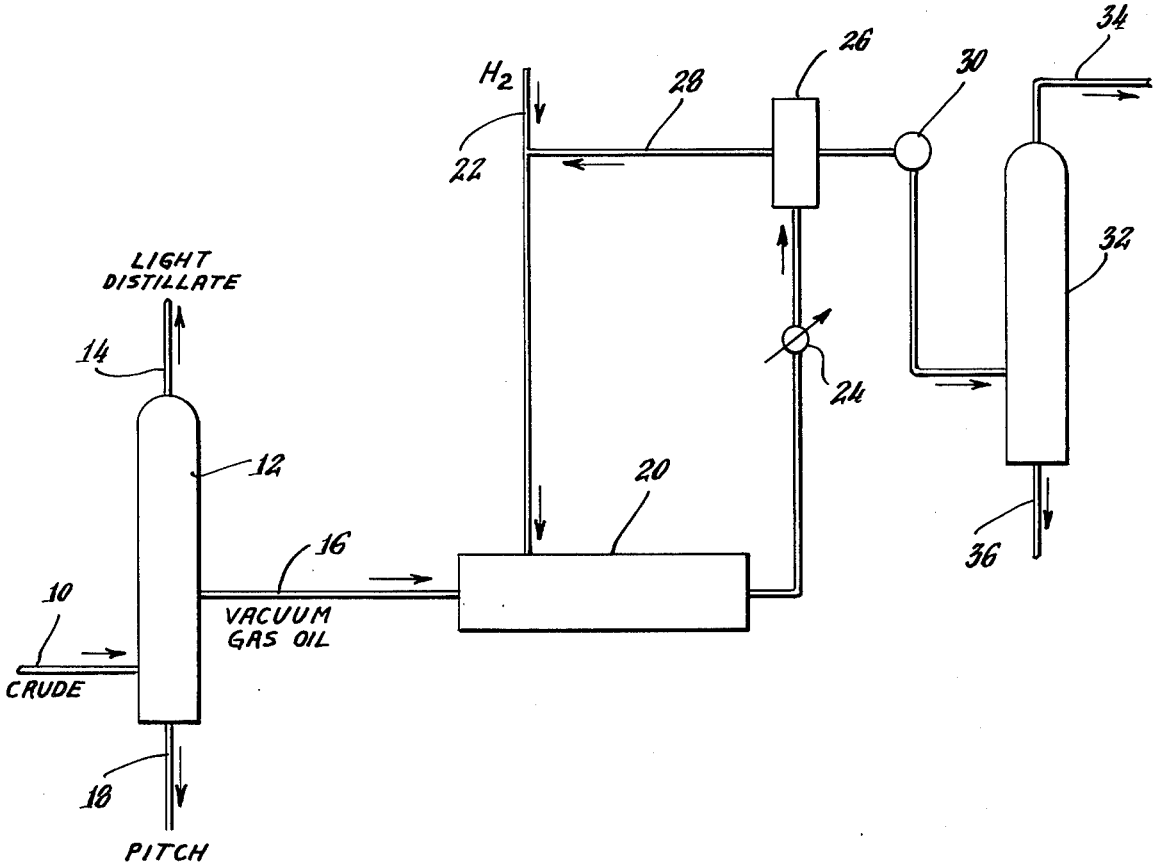
LIGHT DISTILLATE
14
12
10
CRUDE
16
VACUUM GAS OIL
18
PITCH
$H_2$
22
28
20
26
24
30
34
32
36

PROCESS FOR THE PREPARATION OF LOW POUR POINT LUBRICATING OILS

This is a continuation of application Ser. No. 317,608, filed Dec. 22, 1972, now abandoned.

BACKGROUND OF THE INVENTION

1. Field of the Invention

This invention relates to processes for the preparation of either naphthenic or paraffinic lubricating oils from a single crude oil feedstock. More particularly, this invention relates to processes wherein a vacuum distillate from a heavy naphthenic crude oil feedstock undergoes controlled hydrocracking into either a high quality naphthenic or paraffinic lubricating oil characterized by exhibiting a low pour point.

2. Description of the Prior Art

Generally two types of lubricating oil basestocks are commonly used for manufacturers of lubricating oils: (a) paraffinic type and (b) naphthenic type. A finished paraffinic basestock has a viscosity index of at least 80 and usually contains (by mass spectral analysis) 5% or more paraffins. Naphthenic basestocks, on the other hand, have viscosity indices less than 80 and contain less than 5% paraffin molecules. The paraffinic oils are used for the manufacture of high quality products such as motor oils, aviation oils and turbine oils which require high viscosity indices. The naphthenic oils are used in less critical applications in which viscosity index is not important. As a reflection of their low paraffin content, naphthenic oils contain little or no wax (<0.1 wt. %) and their pour points are much lower than for a non-dewaxed paraffinic oil of the same molecular weight. To be useful, paraffinic oils must usually be dewaxed to allow fluidity of the oil even at room temperature. It is obvious that the paraffinic and naphthenic oils come from different types of crude oil and that the necessity of dewaxing paraffinic oils increases their cost relative to naphthenic oils.

Lubricating oils are generally prepared by a series of processes which may involve a solvent extraction process for removal of aromatic, asphaltic and sulfur compounds from the lubricating oil cut, solvent dewaxing with propane or a ketone such as methyl ethyl ketone to remove wax, thereby improving the pour and cloud points, clay contacting which is an absorptive process for improvement of color, acid treatment to remove the aromatic unsaturated portions of the distillate or finally, hydrofining to reduce neutralization number and sulfur and to improve color and stability.

The viscosity index and the pour point are two of the most important characteristics of a lubricant. Successful engine lubrication depends upon maintaining an oil film of sufficient viscosity to prevent metal-to-metal contact of moving surfaces. In general, lubricating oils become less viscous with increasing temperature. It is, therefore, important to know how different oils thin out with increasing temperature. The most commonly used means of expressing this viscosity-temperature relationship is called viscosity index. The viscosity index system is based on two standard oils. A highly naphthenic oil from a Gulf Coast Crude which underwent a very considerable decrease in viscosity with increase in temperature was assigned a viscosity index of zero; whereas, a highly paraffinic oil from Pennsylvania which underwent a relatively small decrease in viscosity with increase in temperature was assigned a viscosity index of 100. A method for calculating viscosity index is given in ASTM Method D-567-53.

The viscosity index of an oil is principally dependent upon its chemical composition. Generally speaking, the chemical nature of oils having a high viscosity index makes them more stable in gasoline engines. Thus, oils of high viscosity index are desirable because of their good viscosity-temperature characteristics and because of their chemical stability.

Pour point is defined as that temperature 5° F above the temperature at which the oil is solid (ASTM Method D-97-57). It is one of the most important characteristics of the lubricant since it represents the limit below which oil cannot flow to the engine parts. If the oil is below its pour point temperature when the engine is started, the oil may not be circulated by the oil pump and the engine may fail because of lack of lubrication. A good quality motor oil should, therefore, always have a pour point at least as low as the lowest temperature at which it might be expected to operate.

The use of solvent refining techniques or polymeric addition agents known as viscosity index improvers has provided means for the regulation and improvement of the viscosity index of lubricating oils. Similarly, the pour point of paraffinic oils can be reduced by solvent dewaxing or the use of additives known as pour depressants.

It would be highly desirable to provide processes for the preparation of high quality paraffinic lubricating oils exhibiting suitably high viscosity indices and low pour points from a single crude oil feedstock. It would be especially desirable to be able to employ a single feedstock and, by regulation of process conditions, be able to obtain either a paraffinic or a naphthenic lubricating oil, as desired. Still further, it would be desirable to provide a versatile lubricating oil manufacturing process which eliminates the need for costly and complex solvent extracting and dewaxing procedures. It would also be desirable to provide processes for the manufacture of high quality lubricating oils from low grade high sulfur heavy naphthenic crude oil feedstocks without the need for preliminary hydrofining to reduce sulfur content to permit conventional processing to be conducted.

SUMMARY OF THE INVENTION

The present invention provides a process for the preparation of low pour point lubricating oils comprising:

i. vacuum distilling a heavy naphthenic crude oil feedstock containing from about 2 to 10 weight % of sulfur based on the weight of the feedstock, said feedstock exhibiting a specific gravity ranging from 5° to 20° API, a wax content of less than 0.5% and a volatility of 10% or less at 400° F, to obtain at least one distillate cut exhibiting a boiling range of from about 500° F to 1100° F at atmospheric pressure and a specific gravity ranging from about 10° to 25° API.

ii. hydrocracking said distillate cut in at least one hydrocracking zone in contact with a hydrocracking catalyst at a temperature from about 650° to 850° F, a hydrogen partial pressure of about 500 to 5000 psig. and a space velocity of from about 0.1 to 2.0 V/V/Hr;

iii. removing the low boiling light ends from the hydrocrackate; and iv. recovering a low pour point lubricating oil.

Depending upon the severity of the temperature used in the hydrocracking operation, a predominantly paraffinic or naphthenic type lube oil base can be obtained.

The present invention will become more apparent from the ensuing discussion and the drawing which schematically illustrates one embodiment of the process of the present invention.

The crude oil feedstocks used for the present invention are generally high sulfur, heavy naphthenic crudes. The naphthenic crude oil feedstock contains from about 2 to 10% by weight sulfur based on the weight of the total feedstock and preferably contains from about 2.5 to 6 weight % sulfur. The specific gravity of such crudes ranges from about 5° to 20° API, and preferably ranges from about 6° to 16° API. Preferably, the crude oil feedstock has a low wax content of less than about 0.5% by weight based on the weight of the total feedstock.

These heavy crudes are further characterized by having 0 to 10 Vol% volatile material boiling below 400° F, 25 to 75 Vol% boiling above 1000° F, 10 to 90 wt. % aromatics and 0.05 to 1 wt. % nitrogen. Vacuum distillates boiling between 500° and 1100° F (atmospheric pressure equivalent) from such heavy crudes have sulfur contents of 1.5 to 10 wt. %, preferably 2 to 8 wt. %, API gravities of 10° to 25°, nitrogen contents of 0.05 to 1 wt. %, aromatics contents of 10 to 90% and less then 0.5 wt. % wax. Typical of such heavy crudes are Cold Lake heavy crude oil, tar sands bitumen, shale oil and the like. Preferred feedstocks for the present process are vacuum distillates; however, deasphalted residua can also be employed.

DESCRIPTION OF THE DRAWING

The drawing shows a flow scheme of a preferred embodiment of the invention. Referring now to the drawing in detail, the crude oil feedstock is fed via line 10 to a vacuum distillation zone 12 wherein a light distillate generally boiling below about 500° F is separated via line 14, a vacuum gas oil cut boiling in the range of about 500° to 1000° F is withdrawn at line 16 and a bottoms fraction boiling above about 1000° F is removed via line 18. Raw residuals, i.e., vacuum or atmospheric distillation bottoms, cannot be employed in the present process because the heavy metal content thereof rapidly deactivates hydrocracking catalysts. The process of the present invention is not appreciably sensitive to the vacuum distillate boiling range. Thus, for example, a wide cut such as 500° to 1000° F or a narrow cut, as for example, 770° to 880° F can be suitably employed. The sulfur content of the vacuum distillate is essentially the same as that of the crude oil feedstock; however, the specific gravity range is somewhat higher generally ranging from about 10° to about 25° API. The vacuum gas oil distillate is then fed to at least one hydrocracking zone 20 wherein it is hydrocracked under controlled conditions to yield either a paraffinic lubricating oil or a naphthenic type lubricating oil, as desired. Regardless of the type of lubricating oil desired, the hydrogen partial pressure within the hydrocracking zone can range from about 500 to 5000 psig. and preferably ranges from about 1000 to 2500 psig. The gas rate within the hydrocracking zone generally ranges from about 1000 to 10,000 SCF $H_2$/B and preferably ranges from about 2000 to 7000 SCF $H_2$/B. The temperature range within the hydrocracking zone can range broadly from about 650° to 850° F. It has been found, however, that through control of the temperature within the hydrocracking zone, either naphthenic or paraffinic type lubricating oils can be obtained. Thus, for naphthenic lubricating oils, a temperature range of preferably from about 675° to 750° F is maintained within the hydrocracking zone; whereas, for paraffinic lubricating oils, the temperature range within the hydrocracking zone is maintained at from about 750° to about 825° F. The space velocity through the hydrocracking zone can range from about 0.1 to 2.0 V/V/Hr and preferably, for obtaining a naphthenic lubricating oil, the space velocity can range from about 0.2 to 1.5 V/V/Hr; for a paraffinic lubricating oil, the space velocity preferably ranges from about 0.1 to 0.75 V/V/Hr.

The hydrocracking zone 20 can contain one or more beds of hydrocracking catalyst whereby the vacuum gas oil distillate is contacted with hydrogen in the presence of a catalyst to effect hydrocracking of the distillate therein.

Useful hydrocracking catalysts include (a) metal compounds contained on a porous non-zeolitic support, and (b) zeolite-containing catalysts having exchanged or deposited catalytic metals. Suitable catalyst materials falling within the first category are the oxides and/or sulfides of Group VIB metals, such as molybdenum and/or tungsten, preferably composited with a Group VIII metal oxide and/or sulfide such as the oxides or sulfides and/or cobalt. Preferred catalysts of this type comprise sulfided composites of molybdenum oxide and nickel oxide supported on a porous, relatively non-cracking carrier such as activated alumina, silica-alumina or other difficulty reducible refractory oxides. When alumina or silica-alumina are employed as supports, they may be promoted with phosphorous or phosphorous-containing compounds such as phosphoric acid. The most preferred catalyst materials of this general type contain about 2–6 wt. % nickel and about 5–25 wt. % molybdenum.

As described above, zeolite-containing materials can also be employed as the hydrocracking catalyst. These catalysts comprise a crystalline aluminosilicate (sieve component) and a porous, relatively inert, thermally stable inorganic adjuvant (amorphous component). The porous adjuvant is preferably alumina, silica and mixtures thereof. The crystalline aluminosilicates employed in the preparation of these catalysts can comprise one or more natural or synthetic zeolites. The porous adjuvant (i.e., amorphous component) may contain metal compounds having hydrogenation activity and, in this embodiment, is similar to those amorphous catalysts described above in connection with group (a) catalyst types. It is noted that, alternatively, zeolite-containing catalysts can be formed in the substantial absence of an amorphous component. Representative examples of particularly preferred zeolites are zeolite X, zeolite Y, zeolite L, faujasite and mordenite. Synthetic zeolites have been generally described in U.S. Pat. Nos. 2,882,244, 3,130,007 and 3,216,789, the disclosures of which are incorporated herein by reference. The aluminosilicate preferably contains a Groups VIB or VIII metal hydrogenation component either exchanged or deposited thereon.

The silica/alumina mole ratio of useful aluminosilicates is greater than 2.5 and preferably ranges from about 2.5 to 10. Most preferably this ratio ranges between about 3 and 6. These materials are essentially the dehydrated forms of crystalline hydrous siliceous zeolites containing varying quantities of alkali metal and aluminum with or without other metals. The alkali metal atoms, silicon, aluminum and oxygen in the zeolites are arranged in the form of an aluminosilicate salt in a definite and consistent crystalline structure. The structure contains a large number of small cavities, interconnected by a number of still smaller holes or channels. These cavities and channels are uniform in size. The pore diameter size of the crystalline aluminosilicate can range from 5 to 15 A and preferably from 5 to 10 A.

The aluminosilicate component may comprise a sieve of one specific pore diameter size or, alternatively, mixtures of sieves of varying pore diameter size. Thus, for example, mixtures of 5 A and 13 A sieves may be employed as the aluminosilicate component. Synthetic zeolites such as type-Y faujasites are preferred and are prepared by well-known methods such as those described in U.S. Pat. No. 3,130,007.

The aluminosilicate can be in the hydrogen form, in the polyvalent metal form or in the mixed hydrogen-polyvalent metal form. The polyvalent metal or hydrogen form of the aluminosilicate component can be prepared by any of the well-known methods described in the literature. Representative of such methods is ion-exchange of the alkali metal cations contained in the aluminosilicate with ammonium ions or other easily decomposable cations such as methyl-substituted quaternary ammonium ions. The exchanged aluminosilicate is then heated at elevated temperatures of about 300°–600° C to drive off ammonia, thereby producing the hydrogen form of the material. The degree of polyvalent metal or hydrogen exchange should be at least about 20%, and preferably at least about 40% of the maximum theoretically possible. In any event, the crystalline aluminosilicate composition should contain less than about 6.0 wt. % of the alkali metal oxide based on the final aluminosilicate composition and, preferably less than 2.0 wt. %, i.e., about 0.3 wt. % to 0.5 wt. % or less.

The resulting hydrogen aluminosilicates can be employed as such, or can be subjected to a steam treatment at elevated temperatures, i.e., 427° to 704° C for example, to effect stabilization, thereof, against hydrothermal degradation. The steam treatment, in many cases, also appears to effect a desirable alteration in crystal structures resulting in improved selectivity.

The mixed hydrogen-polyvalent metal forms of the aluminosilicates are also contemplated. In one embodiment, the metal form of the aluminosilicate is ion-exchanged with ammonium cations and then partially back-exchanged with solutions of the desired metal salts until the desired degree of exchange is achieved. The remaining ammonium ions are decomposed later to hydrogen ions during thermal activation. Here again, it is preferred that at least about 40% of the monovalent metal cations be replaced with hydrogen and polyvalent metal ions.

Suitably, the exchanged polyvalent metals are transition metals and are preferably selected from Groups VIB and VIII of the Periodic Table. Preferred metals include nickel, molbydenum, tungsten and the like. The most preferred metal is nickel. The amount of nickel (or other metal) present in the aluminosilicate (as ion-exchanged metal) can range from about 0.1 to 20% by weight based on the final aluminosilicate composition.

In addition to the ion-exchanged polyvalent metals, the aluminosilicate may contain as non-exchanged constituents one or more hydrogenation components comprising the transitional metals, preferably selected from Groups VIB and VIII of the Periodic Table and their oxides and sulfides. Such hydrogenation components may be combined with the aluminosilicate by any method which gives a suitably intimate admixture, such as by impregnation. Examples of suitable hydrogenation metals, for use herein, include nickel, tungsten, molybdenum, platinum, palladium and the like, and/or the oxides and/or sulfides thereof. Mixtures of any two or more of such components may also be employed. Particularly preferred metals are tungsten and nickel. Most preferably, the metals are used in the form of their oxides. The total amount of hydrogenation components present in the final aluminosilicate composition can range from about 0.05 to 50 wt. %, preferably from 0.1 to 25 wt. % based on the final aluminosilicate composition. The final weight % composition of the crystalline component of the total catalyst will range from about 10 to 70 wt. % and preferably from about 10 to 30 wt. %, i.e., 20 wt. % based on total catalyst. The final weight % composition of the amorphous component will range from about 30 to 90 wt. % and preferably from about 70 to 90 wt. %, i.e., 80 wt. % based on total catalyst.

The amorphous component and the crystalline aluminosilicate component of the catalyst may be brought together by any suitable method, such as by mechanical mixing of the particles thereby producing a particle form composite that is subsequently dried and calcined. The catalyst may also be prepared by extrusion of wet plastic mixtures of the powdered components following by drying and calcination. Preferably the complete catalyst is prepared by mixing the metal-exchanged zeolite component with alumina or silica-stabilized alumina and extruding the mixture to form catalyst pellets. The pellets are thereafter impregnated with an aqueous solution of nickel and molybdenum or tungsten materials to form the final catalyst. The preferred catalyst species are a nickel exchanged hydrogen faujasite admixed with a major amount of aluminum, the final catalyst also containing deposited thereon a minor amount of transition metal hydrogenation component, such as nickel and/or tungsten and/or molybdenum metal or their oxides or sulfides.

Hydrogen is charged to the hydrocracking unit via line 22. The total effluent from the hydrocracking zone 20 is passed into a heat exchanger or suitable cooling device 24. In the heat exchanger 24, the effluent is cooled to temperatures at which the gaseous hydrogen can be separated from the liquid phase. The thus cooled effluent is passed into a high pressure separator 26. The gaseous phase containing substantial amounts of hydrogen is removed and can be recycled after purification, if desired, to the hydrocracking zone 20 through line 28. A liquid product from the high pressure separator 26 is then passed through a depressurizing zone 30. The liquid product from the depressurizing zone 30 is fed to a topping tower 32 wherein low boiling light ends generally having a boiling point below about 700° F and which form useful fuel products are separated via line 34. The lubricating oil product is recovered via line 36.

Thus, the process of the present invention enables the production of low pour point lubricating oils by hydrocracking distillates from high sulfur heavy naphthenic crudes. By controlling the hydrocracking conditions either a low viscosity index naphthenic oil or a higher viscosity index paraffinic oil may be obtained. Both types of oil are obtained in good yield. The high quality and low pour points of the products eliminate the need for both solvent extraction and dewaxing.

PREFERRED EMBODIMENT

The following examples further define, describe and compare methods of preparing lubricating oils in accordance with the present invention. Parts and percentages are by weight unless otherwise indicated.

EXAMPLE 1

Three vacuum gas oils were fractionated from a heavy crude from the Cold Lake area of Alberta; a heavy distillate (boiling range, 880°–980° F, 9.8 LV% on crude), a medium distillate (boiling range, 770°–880° F, 10.9 LV% on crude) and a wide cut distillate (boiling range, 647°–990° F, 36.8 LV% on crude). Each distillate was hydrocracked in a hydrocracking zone containing a fixed bed of 1/16 inch extrudates of sulfided hydrocracking catalyst consisting of:

| | | |
|---|---|---|
| Nio | 2.8 | Wt. % |
| $MoO_3$ | 14.0 | Wt. % |
| $Na_2O$ | 0.08 | Wt. % |
| Fe | 0.03 | Wt. % |
| $SiO_2$ | 1.5 | Wt. % |
| $Al_2O_3$ | balance | |

Hydrocracking conditions within the hydrocracking zone were controlled at 775° F, 0.5 LHSV, 5000 SCF $H_2$/B and 1500 psig. hydrogen partial pressure to provide paraffinic lubricating oils. Inspections of the raw distillates and of the product hydrocracked lubes, topped to remove low boiling (<700° F) light ends, are given in Table I. The inspections of a conventional paraffinic lubricating oil (paraffinic-type 90 V.I. base (150N) from Western Canadian crude) prepared by conventional solvent extraction, dewaxing and hydrofining are also given for comparative purposes in Table I.

It can be seen that the properties of the lubricating oils obtained in accordance with the present invention are substantially equivalent to those of a conventional paraffinic lube despite the elimination of the need for solvent extraction and dewaxing operations.

TABLE I

HYDROCRACKING COLD LAKE VACUUM GAS OIL

| Vacuum Gas Oil Feed | | | | |
|---|---|---|---|---|
| Designation | Heavy | Medium | Wide-Cut | |
| Boiling Range, ° F (AET) | 880–980 | 770–880 | 647–990 | |
| LV% Range on Crude | 42.2–52.0 | 31.3–42.2 | 17.7–54.5 | |
| Yield on Crude, LV% | 9.8 | 10.9 | 36.8 | |
| Gravity, ° A.P.I. | 14.3 | 17.1 | 18.0 | |
| Refractive Index, 60° C | 1.5268 | 1.5160 | 1.5111 | |
| Viscosity, SUS, at 210° F | 121.5 | 55.2 | 48.2 | |
| Sulfur Content, Wt. % | 3.6 | 3.19 | 3.29 | |
| Nitrogen Content, Wt. % | 0.205 | 0.10 | 0.10 | |
| Pour Point, ° F | +30 | −10 | −35 | |
| | | | | Conventional Paraffinic Type Base Oil |
| Lube Product Inspections[3] | | | | |
| Yield, LV% on Feed | 38 | 20 | 27 | — |
| Yield, LV% on Crude | 3.7 | 2.2 | 9.9 | ~ 5 |
| Boiling Range, (Hivac), ° F | 707+ | 738+ | 700+ | — |
| Gravity, ° A.P.I. | 29.1 | 30.0 | 29.1 | 30.7 |
| Refractive Index, 60° C | 1.4741 | 1.4704 | 1.4732 | 1.4667 |
| Refractive Index, 20° C | 1.4882 | 1.4840 | 1.4866 | 1.4801 |
| Viscosity, SUS, 210° F | 44.7 | 43.8 | 43.8 | 43.5 |
| Viscosity, SUS, 100°°F | 171 | 165 | 169 | 160 |
| Viscosity Index | 97 | 91 | 86 | 92 |
| Sulfur, Wt. % | <0.01 | <0.01 | <0.01 | 0.04 |
| Cloud Point, ° F | +75[2] | +30 | +30 | (+15) |
| Pour Point, ° F | +15[1] | −15 | −35 | +10 |
| Color, T.R. | 6½ | 9 | 5½ | 18¾ |
| Viscosity-Gravity Constant | 0.829 | 0.823 | 0.829 | 0.819 |
| Carbon Type Analysis: | | | | |
| Aromatic Carbons, % | 12 | 9 | 10 | 5 |
| Naphthenic Carbons, % | 24 | 27 | 28 | 31 |
| Paraffinic Carbons, % | 64 | 64 | 62 | 64 |

[1]Contains 1 wt. % wax. Addition of 0.1 wt. % Paraflow 52) lowers the pour to −40° F. Dewaxing at 0° F lowers the pour to −20° F. The V.I. of the dewaxed oil is 96.
[2]Cloud wax appears after a day at room temperature.
[3]After topping to remove low boiling product.

EXAMPLE 2

The Cold Lake heavy vacuum gas oil distillate identified in Example 1 having a boiling range of 880° to 980° F was hydrocracked in a hydrocracking zone maintained at 700° F, 0.5 LHSV, 1500 psig. ($H_2$ partial pressure), and 5000 SCF $H_2$/B in contact with the hydrocracking catalyst identified in Example 1. Inspections of the resulting naphthenic lubricating oil product, stripped of light ends, are given in Table II. For comparative purposes, the inspection for a conventional 40 grade low cold test naphthenic lubricating oil prepared by conventional phenol extraction and hydrofining, are also set forth in Table II. It can be seen that the properties of the naphthenic lubricating oil obtained in accordance with the present invention are substantially equivalent to those of a conventional naphthenic lube despite the elimination of the need for solvent extraction.

By comparison of Example 2 with Example 1, it can be seen that the present invention provides a simple, convenient and extremely versatile process wherein a single heavy naphthenic crude oil feedstock can be employed to prepare high quality paraffinic or naphthenic lubricating oils, as desired.

TABLE II

HYDROCRACKING COLD LAKE HEAVY VACUUM GAS OIL FOR LOW COLD TEST NAPHTHENIC LUBES

| | SAE 40 Grade | |
|---|---|---|
| Crude | Cold Lake | Venezuelan |

TABLE II-continued

HYDROCRACKING COLD LAKE HEAVY VACUUM GAS OIL FOR LOW COLD.TEST NAPHTHENIC LUBES

| Raw Distillate | Heavy Vacuum Gas Oil | Heavy Distillate |
|---|---|---|
| Yield on Distillate, LV% | 50[1] | 70[2] |
| Yield on Crude, LV% | 4.9 | ~ 8 |
| Lube Inspections | | |
| Gravity, ° A.P.I. | 25.0 | 25.9 |
| Refractive Index, 60° C | 1.4832 | — |
| Refractive Index, 20° C | 1.4970 | 1.4975 |
| Viscosity, SUS, 210° F | 76.0 | 75 |
| Viscosity Index | 49 | 73 |
| Sulfur Content, Wt% | 0.01 | 0.5 |
| Nitrogen Content, ppm | 33 | 300 |
| Color, T.R. | 10½ | 9 |
| Cloud Point, ° F | −8 | +34 |
| Pour Point, ° F | −10 | +20 |
| Viscosity-Gravity Constant | 0.833 | 0.825 |
| Carbon-Type Analysis: | | |
| Aromatic Carbons, % | 9 | 12 |
| Naphthenic Carbons, % | 31 | 23 |
| Paraffinic Carbons, % | 60 | 65 |

[1]Yield from hydrocracking
[2]Yield from solvent extraction

EXAMPLE 3

A wide cut vacuum gas oil (boiling range 700°–963° F, 32.1 LV% on crude) fractionated from Athabasca Tar Sands bitumen was hydrocracked over the hydrocracking catalyst described in Example 1 at 700° F, 750° F, 775° F and 800° F respectively, and at 0.5 or 0.25 LHSV and 2000 psig. Inspections on the lube products, after light ends stripping, and of the raw gas oil are shown in Table III. The results are similar to those obtained with the Cold Lake distillates in Examples 1 and 2 in that low pour, relatively low V.I. naphthenic oils were produced in the 700° F and 750° F operations and low pour, higher V.I. 10 grade paraffinic lubes at 775° F and 800° F.

Generally, lubricating oils with low pour points, i.e., less than 0° for SAE 0 to 20 and less than 30° for SAE 30 and above with viscosity indices of 80 or less are considered naphthenic and lubricating oils with viscosity indices above 80 as paraffinic.

TABLE III

HYDROCRACKING ATHABASCA BITUMEN VACUUM GAS OIL

| | | | | |
|---|---|---|---|---|
| Vacuum Gas Oil Feed | | | | |
| Boiling Range, ° F (AET) | 700 – 963 | | | |
| LV% Range on Crude | 13.9 – 46.0 | | | |
| Yield on Crude, LV% | 32.1 | | | |
| Gravity, ° API | 15.4 | | | |
| Refractive Index, $n_D$ 60° C | 1.5201 | | | |
| Viscosity, SUS, 210° F | 50.9 | | | |
| Sulfur Content, wt% | 3.05 | | | |
| Nitrogen Content, wt% | 0.14 | | | |
| Pour Point, ° F | −15 | | | |
| Hydrocracking Conditions | | | | |
| Temperature, ° F | 700 | 750 | 775 | 800 |
| Liquid Hourly Space Velocity | 0.5 | 0.25 | 0.5 | 0.5 |
| Pressure, psi | 2000 | 2000 | 2000 | 2000 |
| Gas Rate, SCF $H_2$/B | 5000 | 5000 | 5000 | 5000 |
| Lube Product Inspections (700° F + Boiling Point) | | | | |
| Yield on Feed, LV% | 58.7 | 39.5 | 25.2 | 11.9 |
| Yield on Crude, LV% | 24.8 | 12.7 | 8.1 | 3.8 |
| Gravity, ° API | 24.8 | 28.3 | 31.3 | 32.5 |
| Refractive Index, $n_D$ 60° C | 1.4810 | 1.4705 | 1.4636 | 1.4620 |
| Refractive Index, $n_D$ 20° C | 1.4950 | 1.4855 | 1.4780 | 1.4767 |
| Viscosity, SUS, 210° F | 54.2 | 48.7 | 42.5 | 39.8 |
| Viscosity, SUS, 100° F | 496 | 285 | 148.4 | 107.6 |
| Viscosity Index | 30 | 67 | 85 | 92 |
| Cloud Point, ° F | < −50 | < −50 | +6(faint) | +14 |
| Pour Point, ° F | −30 | −45 | −55 | +5 |
| Color, Tag-Robinson | 18 | — | 16¾ | — |
| Viscosity-Gravity Constant | 0.844 | 0.826 | 0.816 | 0.815 |
| Carbon Type Analysis: | | | | |
| Aromatic Carbons, % | 7 | 5 | 5 | 7 |
| Naphthenic Carbons, % | 39 | 35 | 30 | 26 |
| Paraffinic Carbons, % | 54 | 60 | 65 | 67 |

These examples show that distillates from heavy crudes, such as Cold Lake and Athabasca, may be converted by controlled hydrocracking into either naphthenic or paraffinic lubes. The high quality and low pour points of the products eliminate the need for both solvent extraction and dewaxing.

Although specific materials and conditions were set forth in the above exemplary processes for preparing naphthenic and paraffinic lubricating oils from a single heavy naphthenic crude, these are merely intended as illustrations of the present invention. Various other feedstocks, catalysts, hydrocracking conditions and recovery techniques such as those listed above may be substituted in the examples with similar results. For example, the distillate stream can be split and the respective portions thereof can be simultaneously charged to separate hydrocracking zones, each operated under controlled conditions such that paraffinic lubes would be produced in one zone and naphthenic lubes in the other.

Other modifications of the present invention will occur to those skilled in the art upon a reading of the present disclosure. These are intended to be included within the scope of this invention.

If desired, other processing steps such as solvent extraction can also be conducted with the hydrocracked product to improve, for example, viscosity index or color.

What is claimed is:

1. A process for the preparation of low pour point lubricating oils from heavy naphthenic Cold Lake crude oil feedstocks without the need for solvent extracting and dewaxing procedures which process consists essentially of the sequential steps of:

i. vacuum distilling, in a distillation zone, a heavy naphthenic crude oil feedstock containing from about 2 to 10 weight % of sulfur based on the weight of the feedstock, said feedstock exhibiting a specific gravity ranging from about 5° to 20° API to obtain at least one distillate cut exhibiting a boiling range of from about 500° to 1000° F and a specific gravity ranging from about 10° to 25° API;

ii. passing said distillate cut from said distillation zone directly to at least one hydrocracking zone wherein said distillate cut is contacted with a hydrocracking catalyst at a temperature from about 650° to 850° F, a hydrogen partial pressure of about 500 to 5000 psig and a space velocity of from about 0.1 to 2.0 V/V/Hr;

iii. removing the low boiling light ends from the hydrocrackate; and iv. recovering a low pour point lubricating oil.

2. Process as defined in claim 1 wherein the crude oil feedstock contains from about 2.5 to 6 wt. % sulfur.

3. Process as defined in claim 1 wherein the crude oil feedstock has a wax content of less than about 0.5% by weight based on the weight of the total feedstock.

4. Process as defined in claim 1 wherein the hydrogen partial pressure within the hydrocracking zone ranges from about 1000 to 2500 psig.

5. Process as defined in claim 1 wherein the gas rate within the hydrocracking zone ranges from about 1000 to 10,000 SCF $H_2$/B.

6. Process as defined in claim 1 wherein the temperature range within the hydrocracking zone is maintained at from about 675° to 750° F whereby a naphthenic type lubricating oil is obtained.

7. Process as defined in claim 1 wherein the temperature within the hydrocracking zone is maintained at from about 750° to about 825° F whereby a paraffinic type lubricating oil is obtained.

8. Process as defined in claim 6 wherein the space velocity through the hydrocracking zone ranges from about 0.2 to 1.5 V/V/Hr.

9. Process as defined in claim 7 wherein the space velocity through the hydrocracking zone ranges from about 0.1 to 0.75 V/V/Hr.

10. A process for preparing naphthenic and paraffinic type lubricating oils from a high sulfur, heavy naphthenic Cold Lake crude without the need for solvent extracting and dewaxing procedures which process consists essentially of the sequential steps of:

i. vacuum distilling, in a distillation zone, a heavy naphthenic crude oil feedstock containing from about 2 to 10 weight % of sulfur based on the weight of the feedstock, said feedstock exhibiting a specific gravity ranging from about 5° to 20° API to obtain at least one distillate cut exhibiting a boiling range of from about 500° to 1000° F and a speciific gravity ranging from about 10° to 25° API;

ii. passing said distillate cut directly from the distillation zone to at least one hydrocracking zone wherein said distillate cut is contacted with hydrocracking catalyst at a temperature from about 650° to 850° F, a hydrogen partial pressure of about 500° to 5000 psig and at a space velocity of from about 0.1 to 2.0 V/V/Hr, said temperature being maintained between 750° and 825° F to obtain a lubricating oil predominantly paraffinic in nature, said lubricating oil being characterized by exhibiting a viscosity index of at least 80 and containing at least 5% by weight paraffins, and said temperature being maintained between about 675° and 750° F to obtain a lubricating oil predominantly naphthenic in nature, said naphthenic lubricating oil being characterized by exhibiting a viscosity index less than 80 and containing less than 5% by weight paraffins;

iii. removing the low boiling light ends from the hydrocrackate; and iv. recovering at least one low pour point lubricating oil.

11. A process as defined in claim 10 wherein a portion of said distillate cut is fed to a hydrocracking zone wherein said distillate cut contacts a hydrocracking catalyst at a temperature from about 675° to 750° F and a space velocity ranging from about 0.2 to 1.5 V/V/Hr. to obtain a naphthenic type lubricating oil and another portion of said distillate cut is fed to another hydrocracking zone wherein said distillate cut contacts a hydrocracking catalyst at a temperature from about 750° to about 825° F and a space velocity ranging from about 0.1 to 0.75 V/V/Hr. to obtain a paraffinic type lubricating oil.

* * * * *